US007579948B2

(12) United States Patent
Bohman et al.

(10) Patent No.: US 7,579,948 B2
(45) Date of Patent: Aug. 25, 2009

(54) METHOD AND SYSTEM FOR ARMING A MULTI-LAYERED SECURITY SYSTEM

(75) Inventors: Karl Bohman, Stockholm (SE); Walter Dixon, Delanson, NY (US)

(73) Assignee: Commerceguard AB, Bromma (DE)

( * ) Notice: Subject to any disclaimer, the term of this patent is extended or adjusted under 35 U.S.C. 154(b) by 31 days.

(21) Appl. No.: 11/844,666

(22) Filed: Aug. 24, 2007

(65) Prior Publication Data

US 2007/0285232 A1 Dec. 13, 2007

Related U.S. Application Data

(63) Continuation of application No. 11/202,884, filed on Aug. 12, 2005, now Pat. No. 7,283,052.

(60) Provisional application No. 60/681,105, filed on May 13, 2005.

(51) Int. Cl.
*G08B 13/08* (2006.01)

(52) U.S. Cl. ..... 340/545.6; 340/545.1; 340/572.1

(58) Field of Classification Search ..... 340/541, 340/542, 545.1, 545.2, 547, 545.6, 572.1, 340/572.8, 572.9, 10.1, 10.5, 693.9
See application file for complete search history.

(56) References Cited

U.S. PATENT DOCUMENTS 5,196,828 A * 3/1993 Keniston ..... 340/568.7
5,712,621 A * 1/1998 Andersen ..... 340/547
5,869,908 A * 2/1999 Moczygemba et al. ..... 307/10.5
6,265,973 B1 * 7/2001 Brammall et al. ..... 340/568.1
6,737,962 B2 * 5/2004 Mayor ..... 340/431
6,870,476 B2 * 3/2005 Cockburn et al. ..... 340/541
6,975,224 B2 * 12/2005 Galley et al. ..... 340/539.18
7,046,137 B2 * 5/2006 Palmquist ..... 340/539.11
7,068,162 B2 * 6/2006 Maple et al. ..... 340/539.11
7,183,920 B2 * 2/2007 Napolitano ..... 340/572.1
7,283,052 B2 * 10/2007 Bohman et al. ..... 340/572.1
7,382,251 B2 * 6/2008 Bohman et al. ..... 340/545.1
2005/0253708 A1 * 11/2005 Bohman et al. ..... 340/539.22
2006/0090079 A1 * 4/2006 Oh et al. ..... 713/186
2007/0001855 A1 * 1/2007 Bohman et al. ..... 340/572.1

* cited by examiner

*Primary Examiner*—Toan N Pham
*Assistant Examiner*—Travis R Hunnings
(74) *Attorney, Agent, or Firm*—Global Patent Operation

(57) ABSTRACT

A system and method for securing a container is disclosed. A sensor secures the container and may be configured to detect an opening of a door of the container. The sensor may be a container security device. An arming device may be coupled with the sensor to transmit a unique identifier to the sensor. The arming device may be a remote arming plug. The sensor may combine the unique identifier with a tag key to create an arming key. As part of the arming sequence, the sensor may enter a pre-armed state. After the door of the container is closed, the sensor may count down and change to an armed state when the countdown ends. The arming device may be removably coupled to the container security device. The arming device may also include a bolt. The arming device and/or the bolt may be coupled with a door securing device.

24 Claims, 15 Drawing Sheets

METHOD AND SYSTEM FOR ARMING A MULTI-LAYERED SECURITY SYSTEM

CROSS-REFERENCES TO RELATED APPLICATIONS

This application is a continuation of U.S. patent application Ser. No. 11/202,884 filed on Aug. 12, 2005, now U.S. Pat. No. 7,283,052 which claims the benefit of priority from U.S. Provisional Patent Application No. 60/681,105 filed May 13, 2005, the contents of each of which are hereby incorporated by reference in their entirety.

This Application relates to patent application Ser. No. 11/099,831, entitled "Method And System For Arming A Container Security Device Without Use Of An Electronic Reader," filed on Apr. 6, 2005, the disclosure of which is incorporated by reference herein. This Application also relates to patent application Ser. No. 10/847,185, entitled "Method And System For Utilizing Multiple Sensors For Monitoring Container Security, Contents And Condition," filed on May 17, 2004, the disclosure of which is incorporated by reference herein.

BACKGROUND

1. Technical Field

The field of the invention relates to a method of and system for remotely arming a container security device with a remote arming plug and, after arming, utilizing the remote arming plug as a physical seal, which may be mechanical or electronic, and which meets the ISO standard for high security seals, ISO 17172.

2. History of Related Art

The vast majority of goods shipped throughout the world are shipped via what are referred to as intermodal freight containers. As used herein, the term "containers" includes any container (whether with wheels attached or not) that is not transparent to radio frequency signals, including but not limited to, intermodal freight containers. The most common intermodal freight containers are known as International Standards Organization (ISO) dry intermodal containers, meaning they meet certain specific dimensional, mechanical and other standards issued by the ISO to facilitate global trade by encouraging development and use of compatible standardized containers, handling equipment, ocean-going vessels, railroad equipment and over-the-road equipment throughout the world for all modes of surface transportation of goods. There are currently more than 19 million such containers in active circulation around the world as well as many more specialized containers such as refrigerated containers that carry perishable commodities. The United States alone receives approximately 10 million loaded containers per year, or over 25,000 per day, representing nearly half of the total value of all goods received each year.

Since approximately 90% of all goods shipped internationally are moved in containers, container transport has become the backbone of the world economy.

The sheer volume of containers transported worldwide renders individual physical inspection impracticable, and only approximately 5% of containers entering the United States are actually physically inspected. Risk of introduction of a terrorist biological, radiological or explosive device via a freight container is high, and the consequences to the international economy of such an event could be catastrophic, given the importance of containers in world commerce.

Even if sufficient resources were devoted in an effort to conduct physical inspections of all containers, such an undertaking would result in serious economic consequences. The time delay alone could, for example, cause the shut down of factories and undesirable and expensive delays in shipments of goods to customers.

Current container designs fail to provide adequate mechanisms for establishing and monitoring the security of the containers or their contents. A typical container includes one or more door hasp mechanisms that allow for the insertion of a plastic or metal indicative "seal" or bolt barrier conventional "seal" to secure the doors of the container. The door hasp mechanisms that are conventionally used are very easy to defeat, for example, by drilling an attachment bolt of the hasp out of a door to which the hasp is attached. The conventional seals themselves currently in use are also quite simple to defeat by use of a common cutting tool and replacement with a rather easily duplicated seal. However, there are other more secure (according to U.S. Customs and Border Protection) sealing locations that may potentially be used for applying the mechanical seal. Various different locations along the container doors known in the industry for attaching the mechanical seal include the "Pardo Hole," "Enhanced Lock Device" by P&O Nedlloyd, and "SecureCam."

A more advanced solution proposed in recent times is known as an "electronic seal" ("eseal"). The e-seals are equivalent to traditional door seals and are applied to the containers via the same, albeit weak, door hasp mechanism as an accessory to the container, but include an electronic device such as a radio or radio reflective device that can transmit the e-seal's serial number and a signal if the e-seal is cut or broken after it is installed. However, an e-seal is not able to communicate with the interior or contents of the container and does not transmit information related to the interior or contents of the container to another device. The e-seals may also actually weaken security because they will not be physically inspected. For example, there is no way to verify that an e-seal is actually securing the container door. It could be attached anyplace on the container and read remotely.

A container security device, as described in U.S. patent application Ser. No. 10/667,282, entitled "Method And System For Monitoring Containers To Maintain The Security Thereof," filed Sep. 17, 2003, must be armed in order to be able to monitor the integrity of the container doors while the container is in transit. However, one of the challenges in implementing a global in-transit security system for freight containers is to adequately distribute the global reader infrastructure so as to be able to arm the container security device on demand anywhere in the world, i.e., to download to a given container security device an encrypted arming key that has been issued by an authorized arming server. There are hundreds of thousands of shippers of cargo containers in over 130 countries that would potentially need to use some type of reader device in order to perform such arming transactions.

This need for reader devices poses a problem when the shipper does not ship regularly and/or does not have an account with the carrier, as it becomes problematic to distribute readers. Furthermore, it is not unusual that some shippers have their location in remote places (e.g., inland China, Africa or Latin America), where there is limited or no wired, wireless public network coverage nor Internet capability, or where such IT capabilities are too expensive. In such cases, which are not expected to be unusual or uncommon in terms of the number of locations but rather pre-dominant, it may be very difficult to distribute the readers and thus implement a global in-transit container security system.

It would therefore be advantageous to provide a method of and system for remotely arming a container security device without use of a reader device while still maintaining a very high security and secure authentication process. It would also be advantageous to utilize a device for remotely arming the container security device to also be used as part of a mechanical seal to physically secure the container's doors after the arming process has been completed. Further, after receiving the container, cutting the mechanical seal, and opening the doors, it would be advantageous to verify that the device on the mechanical seal is the same device that was originally put on at the point of stuffing/sealing the container. Finally, it would be also be useful to use the same device to download a log of trip from the container security device, take it back to a personal computer, and automatically authenticate the entire trip as well as upload the data log.

SUMMARY OF THE INVENTION

These and other drawbacks are overcome by embodiments of the present invention, which provides a method of and system for efficiently and reliably monitoring a container and its contents as well as tracking containers to maintain the security thereof. More particularly, one embodiment of the invention includes a system for monitoring the condition of a container. A container security device secures the container. The container security device is programmably armed to implement the securing. The container security device is adapted to sense at least one condition of the container, transmit information relative to the at least one sensed condition to a location outside the container, and interpret the at least one condition. A remote arming plug is adapted to be removably coupled to the container security device. The remote arming plug has a unique identifier to be communicated to the container security device to initiate an arming sequence of the container security device. The remote arming plug is adapted to be applied as an integrated deployable seal to at least one sealing location to physically secure the container. The remote arming plug forms a seal meeting ISO 17172. Another embodiment of the invention is directed to a method for monitoring the condition of a container. The container is secured with a container security device. The container security device is adapted to sense at least one condition of the container, transmit information relative to the at least one sensed condition to a location outside the container, and interpret the at least one condition. An arming sequence of the container security device is initiated in response to a movement of a remote arming plug relative to the container security device. The remote arming plug has a unique identifier to be communicated to the container security device to initiate an scanning sequence of the container security device. The remote arming plug is applied as an integrated deployable seal to at least one sealing location to physically secure the container.

An additional embodiment of the invention is directed to a remote arming plug for storing a unique identifier to be communicated to a container security device of a container to initiate an arming sequence of the container security device. The remote arming plug includes a communication element for communicating a unique identifier to the container security device, and a receiving aperture for receiving a securing element. The securing element applies the remote arming plug as an integrated deployable seal to at least one sealing location to physically secure the container.

Another embodiment of the invention is directed to a method for monitoring the condition of a container. A container secured with a container security device is received. The container security device is adapted to sense at least one condition of the container, transmit information relative to the at least one condition to a location outside the container, and interpret the at least one condition. A unique identifier of a remote arming plug is verified. During shipment of the container, the remote arming plug is applied as an integrated deployable seal to at least one sealing location to physically secure the container. Data of the shipment is downloaded from the container security device to the remote arming plug.

Another embodiment of the invention is directed to a system for monitoring the condition of a container. A container security device secures at least one door of the container. The container security device is programmably armed to implement the securing. The container security device is adapted to sense at least one condition of the container, transmit information relative to the at least one sensed condition to a location outside the container, and interpret the at least one condition. A token authenticates an authorized person to arm the container security device. The token communicates a unique identifier to the container security device to initiate an arming sequence of the container security device. A remote arming plug is adapted to be removably coupled to the token. The remote arming plug has the unique identifier to be communicated to the token. The remote arming plug is adapted to be applied as an integrated deployable seal to at least one sealing location to physically secure the container.

BRIEF DESCRIPTION OF DRAWINGS

A more complete understanding of exemplary embodiments of the present invention can be achieved by reference to the following Detailed Description of Exemplary Embodiments of the Invention when taken in conjunction with the accompanying Drawings, wherein.

DETAILED DESCRIPTION OF EXEMPLARY EMBODIMENTS OF THE PRESENT INVENTION

Figure 1A:
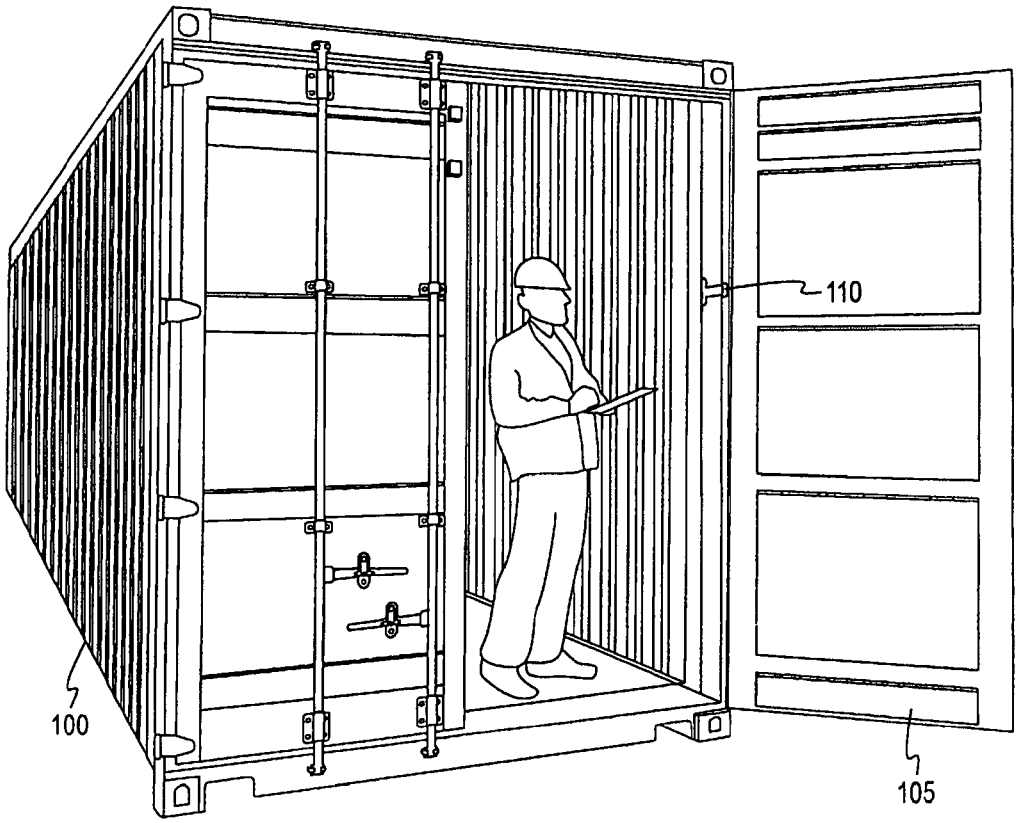
FIG. 1A is a diagram illustrating a container according to an embodiment of the invention.

It has been found that a container security device of the type set forth, shown, and described below, may be positioned in and secured to a container for effective monitoring of the integrity with the optional monitoring of the condition thereof and the container's contents. The container security device has to be armed with a unique electronic arming key for authentication purposes. The container security device can be armed using a reader device, in which case the arming key is retrieved and downloaded from an authentication server that issues the arming key.

Alternatively, according to embodiments of the present invention, a remote arming plug is initially coupled to the container security device. The arming key is generated in the container security device itself once the remote arming plug has been disconnected and the container's doors have been closed. Accordingly, the container security device can be armed with a unique arming key without use of a reader device. However, after the remote arming key has been generated, the remote arming key must subsequently be authenticated. As a subsequent entity in the shipping chain that has a reader interrogates the container security device, the arming key in the container security device is authenticated by the authentication server.

A container security device may be used to secure at least one door of the container. The container security device may be similar to the one disclosed in pending U.S. patent application Ser. No. 10/667,282, filed on Sep. 17, 2003, the disclosure of which is incorporated by reference herein. The container security device is armed with a unique, encrypted arming key, which ensures the security of the system. The container security device is adapted to sense at least one condition of the container, transmit information relative to the at least one sensed condition to a location outside the container, and interpret the at least one sensed condition. A cornerpiece of embodiments of the present invention consists of a so-called remote arming plug. The remote arming plug has a unique identifier such as a unique pin combination, a serial number, etc., and a key for authentication. The remote arming plug communicates this unique identifier to the container security device via any suitable manner such as, e.g., infrared, a wireless connection, or a physical connection. The unique identifier could also be communicated in an ultrasonic manner. The connector could be a RS-232 connector (D-SUB) which could connect to the data port on the back of the container security device, but it could be any other type of connector and connect to other part(s) of the container security device. The remote arming plug may have a unique serial number physically marked (numbers written or bar codes) on it, as well as programmed (once) in its electronic memory.

The remote arming plug may include a bolt. When the remote arming plug is initially coupled to the container security device, the bolt may be initially attached to the back portion of the remote arming plug. After the remote arming plug is removed from the container security device and the container security device has been activated, the container doors are shut. The bolt is then removed from the remote arming plug. The remote arming plug is typically placed somewhere on/near the doors of the container, and the bolt is inserted through a hasp on one of the doors and into a receiving aperture on the remote arming plug. Accordingly, the remote arming plug and its bolt are used as a mechanical seal for the container being shipped. Alternatively, instead of being a bolt seal, the seal may be a cable seal, e-seal, or any other seal that meets the ISO 17172 seal standard. The remote arming plug may be also used as part of an ISO 17172-compliant e-seal, instead of as part of a mechanical seal. The remote arming plug may also be used as part of a seal that is compliant with derivatives/improvements of ISO 17172. When the container is received at a point during the supply chain, a serial number of the remote arming plug may be manually read from or communicated by the remote arming plug.

FIG. 1A is a diagram illustrating a container 100 according to an embodiment of the invention. The container 100 is stuffed with various materials to be transported by a shipper. The container 100 has doors 105 that are opened when the shipper initially stuffs the container 100. A sensor 110, one example of which is a container security device, secures the container's 100 doors 105 after they have closed and until the container security device 110 is properly disarmed such as when, e.g., the container 100 reaches its final destination and its doors 105 need to be opened to remove the container's 100 contents. The container security device 110 will activate an alarm when the container's 100 doors 105 are opened without being properly disarmed. The container security device 110 ensures that the container 100 has not been breached after the container 100 has been secured. The process for arming the container security device 12 is described below with respect to FIGS. 3A-D.

Figure 1B:
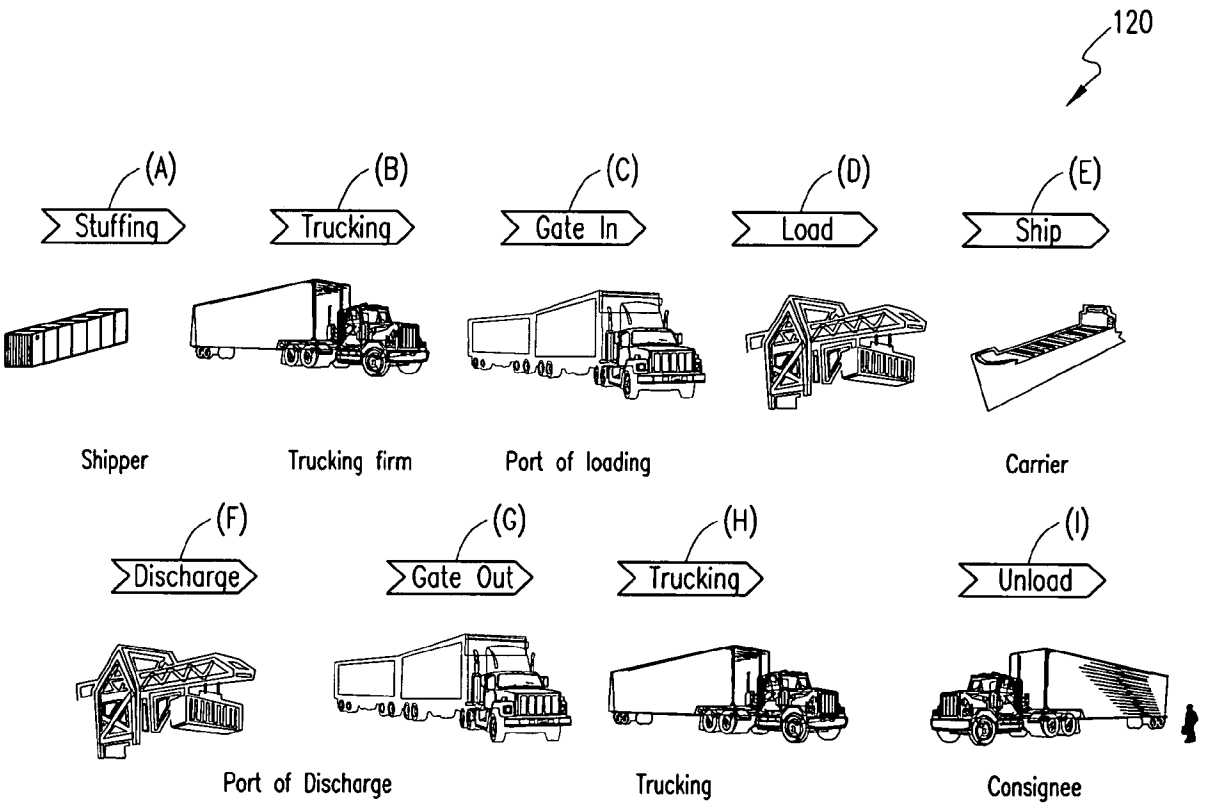
FIG. 1B illustrates a flow of an exemplary supply chain.

FIG. 1B illustrates a flow 120 of an exemplary supply chain from points (A) to (I). Referring first to point (A), the container 100 is filled with cargo by the shipper or the like. At point (B), the loaded container 100 is shipped to a port of embarkation via highway or rail transportation. At point (C), the container 100 is gated in at the port of loading such as a marine shipping yard.

At point (D), the container 100 is loaded on a ship operated by a carrier. At point (E), the container 100 is shipped by the carrier to a port of discharge. At point (F), the container 100 is discharged from the ship. Following discharge at point (F), the container 100 is loaded onto a truck and gated out of the port of discharge at point (G). At point (H), the container 100 is shipped via land to a desired location in a similar fashion to point (B).

At point (I), upon arrival at the desired location, the container 100 is unloaded by a consignee.

As will be apparent to those having ordinary skill in the art, there are many times within the points of the flow 120 at which security of the container 100 could be compromised without visual or other conventional detection. In addition, the condition of the contents of the container 100 could be completely unknown to any of the parties involved in the flow 120 until point (H) when the contents of the container 100 are unloaded.

Figure 3A:
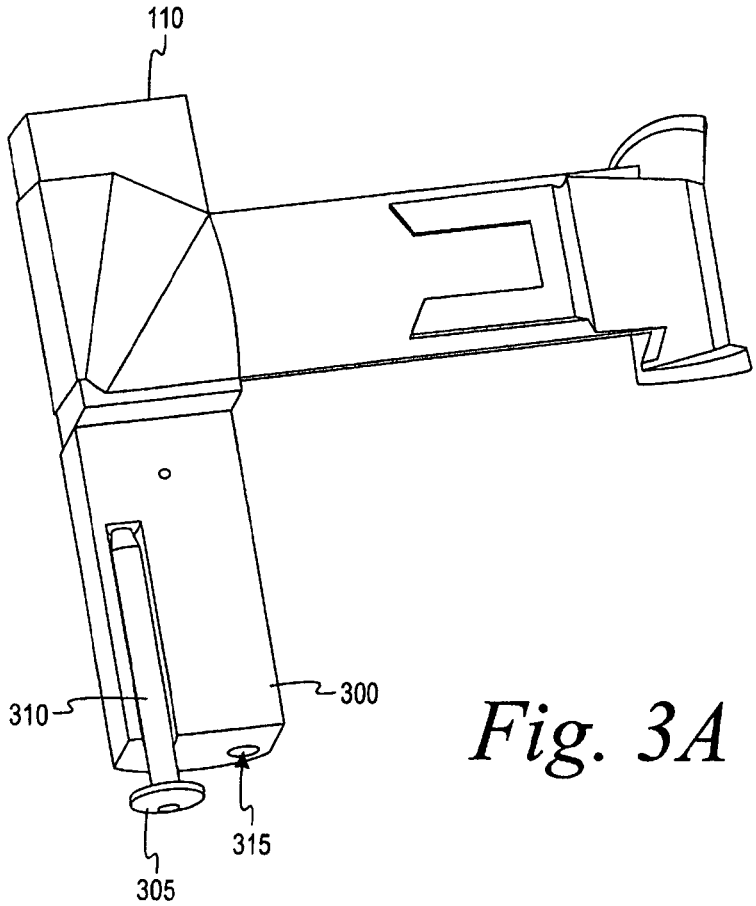
FIGS. 3A-D illustrate various views of a container security device and a remote arming plug according to an embodiment of the invention.
Figure 3B:
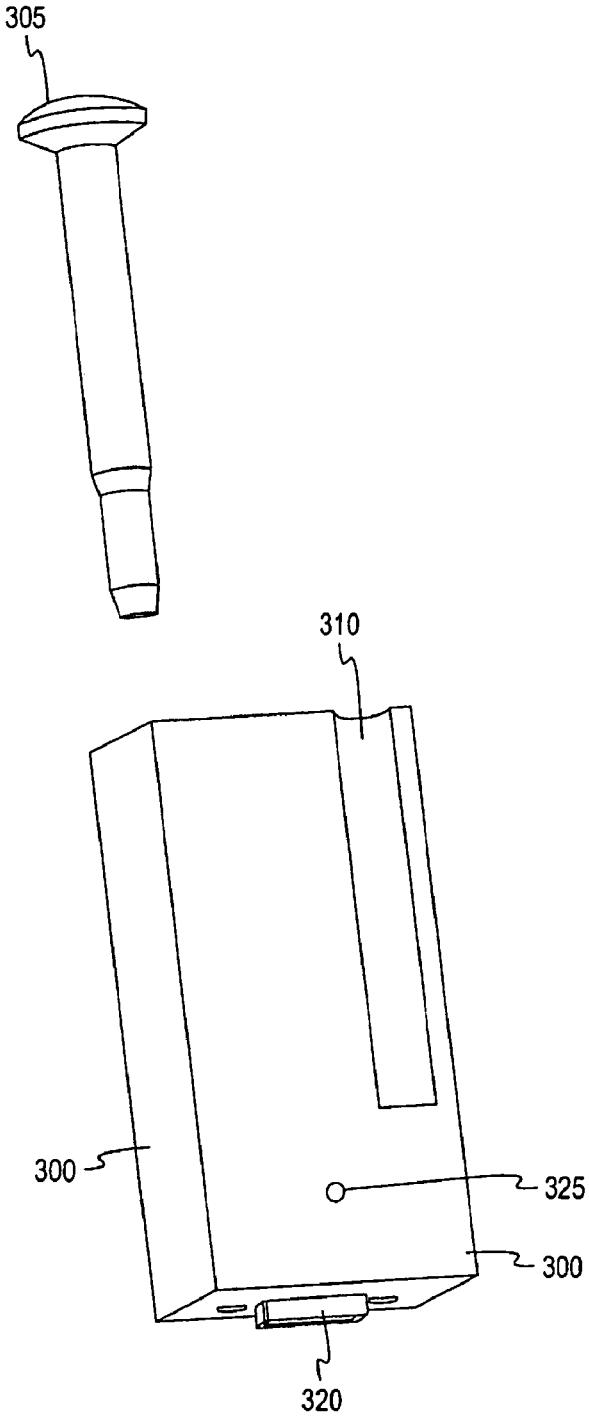

As discussed above, the container security device 110 is armed during shipping for security purposes. The container security device 110 may be armed without use of an electronic reader. Accordingly, a shipper who does not have any readers can aim the container security device 110. Instead, the container security device can be armed through use of an arming device, provided (a) the container security device has been pre-loaded with at least one registered key, and the unique identifier of the arming plug is associated with one of the at least one arming key; (b) the unique identifier is read from the arming device and is used in the container security device to calculate a unique arming key; or (c) the container security device acquires an arming key from the arming device. An example of an arming device may include a remote arming plug as shown in FIG. 3B having a unique identifier stored within a computer-readable memory of the arming device. The unique identifier may be transmitted to the sensor and combined with a tag key to arm the sensor to detect an opening of a door of the container. An example of a unique identifier may include a unique serial number of the arming device.

Figure 1C:
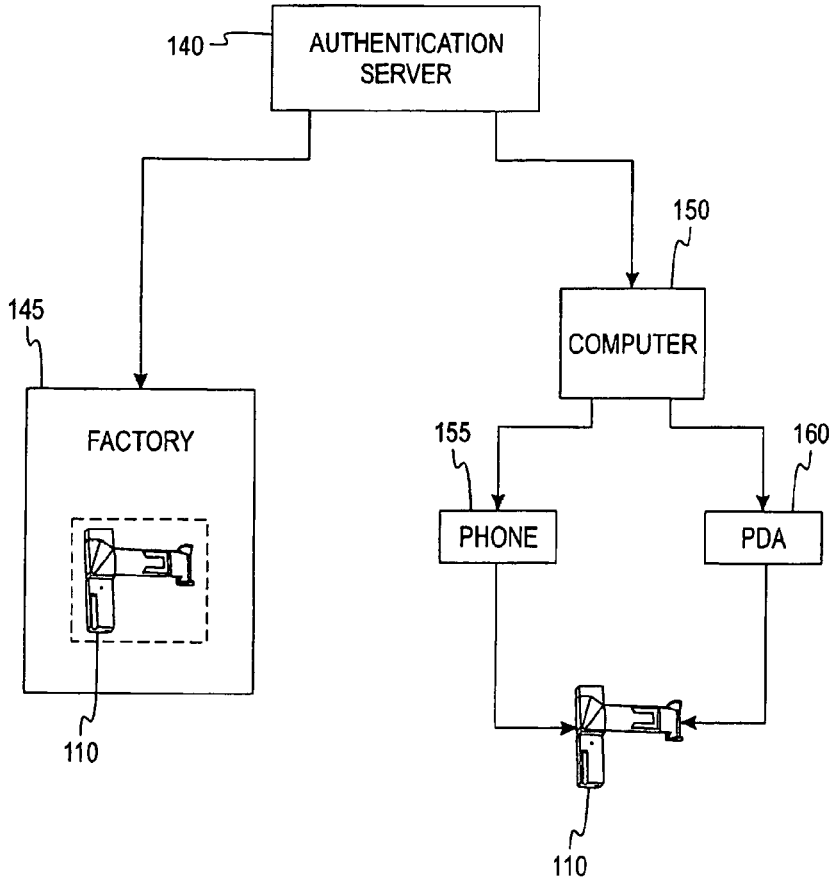
FIG. 1C illustrates a system for pre-loading keys into the container security device according to an embodiment of the invention.

FIG. 1C illustrates a system for pre-loading keys into the container security device 110 according to an embodiment of the invention. The system includes an authentication server 140. The authentication server 140 generates keys and may transmit the keys to a factory 145, where container security devices 110 are manufactured. Accordingly, the new keys may be stored directly onto the newly manufactured container security devices 110 before the container security devices 110 are used in the field. A container security device 110 that is already in use may also be re-filled with additional keys in the field.

For example, the authentication server 140 may transmit additional keys to a computer 150, such as a portable laptop. The computer 150 may transmit the keys to a portable electronic device in communication with the container security device 110 being re-filled, such as phone 155 or personal digital assistance ("FDA") 160. Each key may be a unique number, and a different key may be used each time the container security device 110 is armed and a container 100 having the container security device 110 ships.

Figure 2:
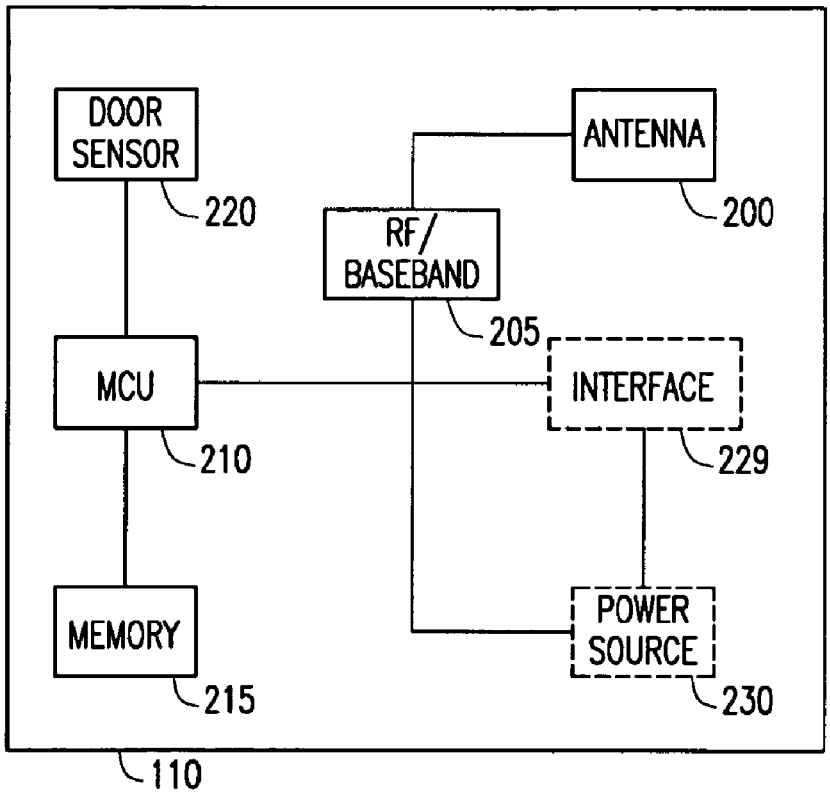
FIG. 2 is a block diagram of electrical components of the container security device.

FIG. 2 is a block diagram of electrical components of the container security device 110. The container security device 110 includes an antenna 200, an RF baseband unit 205, a microprocessor (MCU) 210, a memory 215, and a door sensor 220. The container security device 110 further includes an interface 229 for attachment of additional sensors to monitor various internal conditions of the container such as, for example, temperature, vibration, radioactivity, gas detection, and motion. A remote arming plug may be coupled to the interface 229 to arm the container security device 110, as described but not limited below with respect to FIGS. 3A-D.

The container security device 110 may also include an optional power source 230 (e.g., battery); however, other power arrangements that are detachable or remotely located may also be utilized by the container security device 110. When the power source 230 includes a battery (as shown herein), inclusion of the power source 230 in the container security device 110 may help to prolong battery life by subjecting the power source 230 to smaller temperature fluctuations by virtue of the power source 230 being inside the container 100. The presence of the power source 230 within the container 100 is advantageous in that the ability to tamper with or damage the power source 230 is decreased. The container security device 110 may also optionally include a connector for interfacing directly with an electronic reader. For example, a connector may be located on an outer wall of the container 100 for access by the reader. Although not required to arm the container security device 110, the reader may connect via a cable or other direct interface to download information from the container security device 110.

The microprocessor 210 (equipped with an internal memory) discerns door 105 events from the door sensor 230, including, for example, container-disarming requests, and container-security checks. The discerned door events also include security breaches that may compromise the contents of the container 100, such as opening of a door 105 after the container 100 has been secured. The door events may be time-stamped and stored in the memory 215 for transmission to the reader. The door events may be transmitted immediately, periodically, or in response to an interrogation from the reader.

The door sensor 230 shown herein is of the pressure sensitive variety, although it may be, for example, an alternative contact sensor, a proximity sensor, or any other suitable type of sensor detecting relative movement between two surfaces. The term pressure sensor as used herein thus includes, but is not limited to, these other sensor varieties.

The antenna 200 is provided for data exchange with the reader. In particular, various information, such as, for example, status and control data, may be exchanged. The microprocessor 210 may be programmed with a code that uniquely identifies the container 100. The code may be, for example, an International Standards Organization (ISO) container identification code. The microprocessor 210 may also store other logistic data, such as Bill-of-Lading (BIL), a mechanical seal number, a reader identification with a timestamp, etc. A special log file may be generated, so that tracking history together with door 105 events may be recovered. The code may also be transmitted from the container security device 110 to the reader for identification purposes. The RF/baseband unit 205 upconverts microprocessor signals from baseband to RF for transmission to the reader.

The container security device 110 may, via the antenna 200, receive an integrity inquiry from the reader. In response to the integrity query, the microprocessor 210 may then access the memory 215 to extract, for example, door events, temperature readings, security breaches, or other stored information in order to forward the extracted information to the reader. The reader may also send a disarming request to the container security device 110. When the container 100 is armed, the memory 215 of the container security device 110 may be programmed to emit an audible or visual alarm when the door sensor 230 detects a material change in pressure after the container 100 is secured. The container security device 110 may also log the breach of security in the memory 24 for transmission to the reader. If the reader sends a disarming request to the container security device 110, the microprocessor 210 may be programmed to disengage from logging door 105 events or receiving signals from the door sensor 230 or other sensors interoperably connected to the container security device 110.

The shipper may arm a container security device 110 that has a pre-loaded security key, and the container security device 110 may be later authenticated by another entity (e.g., another entity along the supply chain) checking the container security device 110 with a reader.

In order to arm the container security device 110 without use of a reader, a remote arming plug is required. FIG. 3A illustrates a container security device 110 and a remote arming plug 300 according to an embodiment of the invention. The container security device 110 is mounted on to the doorframe 105 of the container 100, as shown in FIG. 1. The shipper may have pre-purchased a plurality of remote arming plugs 300. When the shipper desires to arm a container security device 110 before shipping a container 100, the shipper selects one of the remote arming plugs 300 and then manually inserts the remote arming plug 300 into the interface 229 of the container security device 110.

Alternatively, instead of manually the remote arming plug 300 into the interface 229, a wireless or contact connection may be made between the remote arming plug 300 and the container security device 110. The interface 229 may include a female connector, and the remote arming plug 300 may include a male connector, and the combination of active pins of the remote arming plug 300 may be utilized to uniquely identify the remote arming plug 300. The remote arming plug 300 may also include a serial number written somewhere on its body.

As shown, the remote arming plug 300 may include a bolt 305 housed within a bolt sleeve 310. The bolt 305 is utilized to secure the remote arming plug 300 to the container's doors 105, as discussed below with respect to FIGS. 6A-D. The remote arming plug 300 also includes a receiving aperture 315 for receiving the bolt 305 when the remote arming plug 300 is used as a mechanical seal. The bolt 305 is typically utilized only in the event that the mechanical seal is a bolt seal. However, in an embodiment where the seal is an e-seal, a cable seal, or any other type of ISO 17172-compliant seal, the bolt 305 is not necessary.

FIG. 3B illustrates the remote arming plug 300 after the bolt 305 has been removed from the bolt sleeve 310. When the shipper has stuffed a container 100 and is ready to arm the container security device 110, the shipper inserts the male end 320 of the remote arming plug into the interface 229 of the container security device 110. Once inserted, an indicator 325 on the remote arming plug 300 indicates in an intuitive way whether the remote arming plug 300 is in communication with the container security device 110. In other embodiments, an indicator 325 is not necessary. The indicator 325 may include, e.g., a Light Emitting Diode ("LED"), a Liquid Crystal Display ("LCD"), an element that emits audible sounds, a vibrating element, or any other type of lighting element that flashes, varies a blink rate, etc., to indicate a condition of the remote arming plug 300.

As illustrated in FIG. 3B, the bolt 305 may have a cylindrical, elongated shape. An end of the bolt 305 that removably fits within a receiving aperture formed in the housing of the remote arming plug 300 may be tapered. The opposite end of the bolt 305 may include a flange. The bolt 305 may be held within the bolt sleeve 310 by friction, snap-fit, or other means of securing.

For example, the indicator 325 may include an LED that begins blinking green when successful communication is established between the remote arming plug 300 and the container security device 110. While the indicator 325 blinks green, the serial number or other unique identifier of the remote arming plug 300 is uploaded to the container security device 110. The container security device 110 receives the serial number through its interface 229 which is in communication with the male end 320 of the remote arming plug 300. Alternatively, the container security device 110 may receive the serial number via infra-red, an ultra-sonic communication, wireless communication, magnetics, or in any other suitable manner.

Figure 3C:
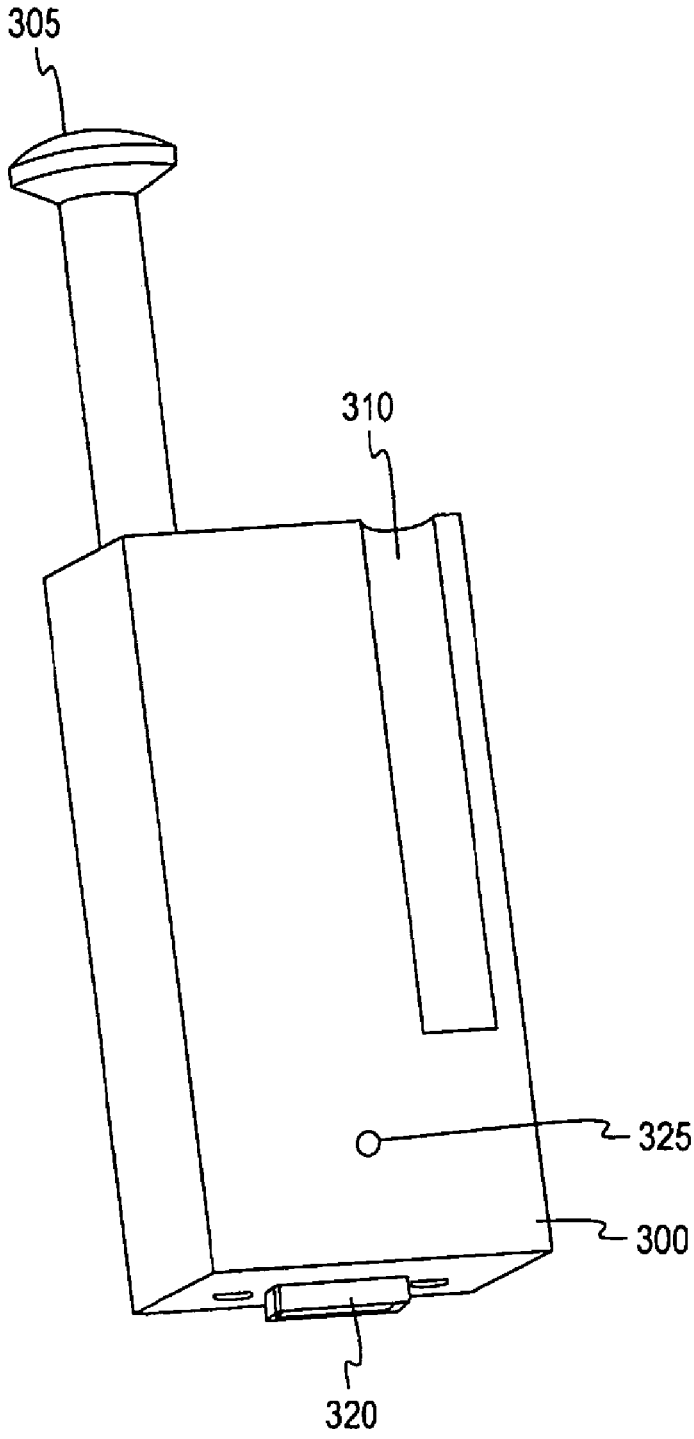

Once the serial number has been successfully uploaded and the arming process in the container security device 110 is initiated, the indicator 325 will indicate this status in an intuitive way. For example, the indicator 325 may display a solid green color, instead of a blinking green color, to indicate that the remote arming plug 300 may be removed from the container security device 110. Once removed, an arming activation routing for the container security device 110 is activated. Alternatively, if an indicator is not present on the remote arming plug, the arming activation routing is automatically initiated after the serial number of the remote arming plug 300 has been successfully uploaded. After the remote arming plug 300 is removed, the container doors 105 are shut, and the bolt 305 may be inserted into the receiving aperture 315 for locking the container doors 105 as part of the mechanical seal. FIG. 3C illustrates the remote arming plug 300 when the bolt has been inserted into the receiving aperture 315. The remote arming plug 300 may be formed of a hard plastic having a metal portion disposed therein, and the bolt 305 may be formed of a metal.

Figure 3D:
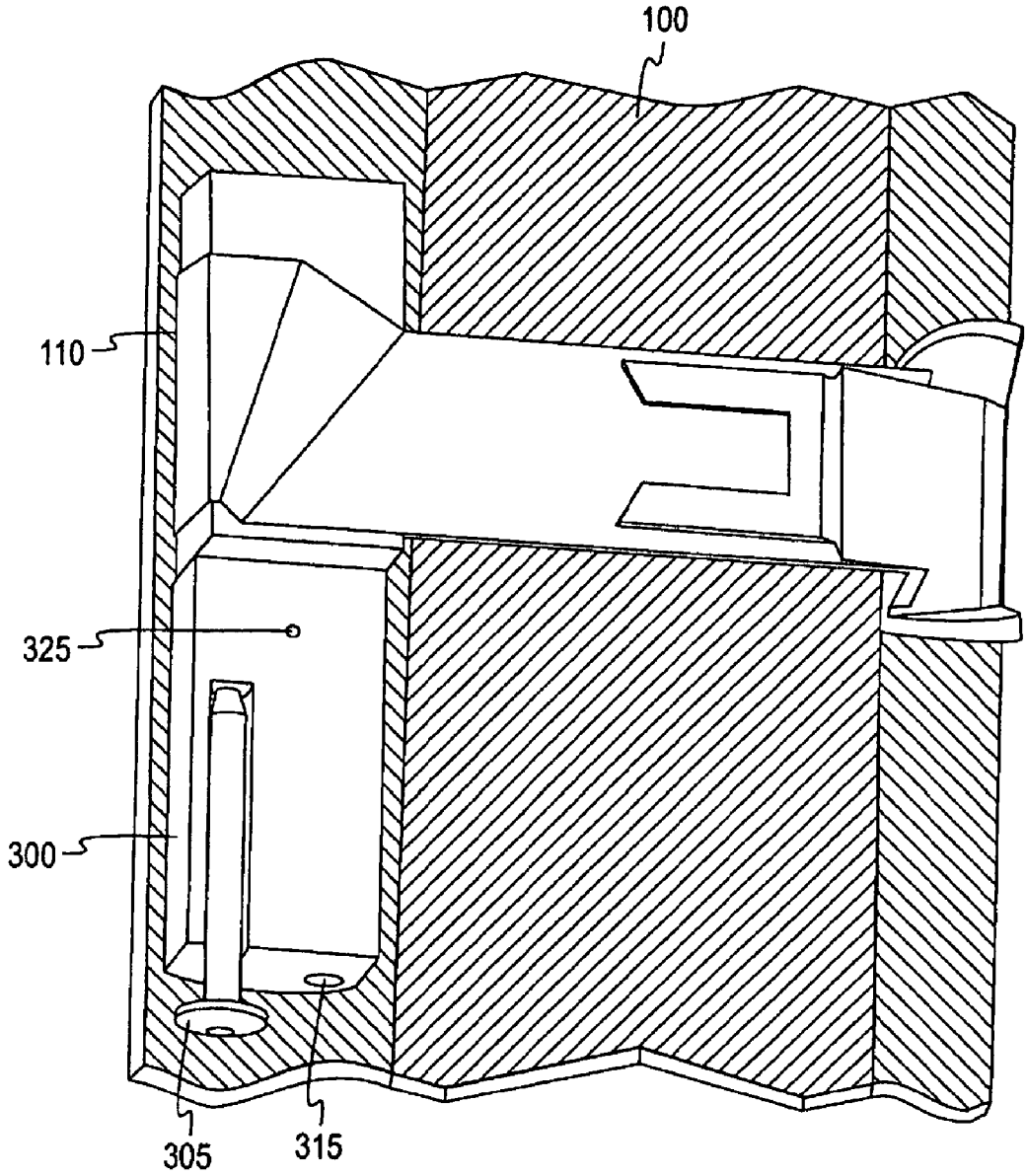

In practice, the container security device 110 is mounted onto the container's 100 doorframe, as shown in FIG. 3D. Once the container 100 is fully stuffed, the male end 320 of the remote arming plug 300 is initially inserted into the interface 229. To arm the container security device 110, the remote arming plug 300 is removed from the interface 229. The remote arming plug 300 may be manually removed from the container security device 110. After a short delay such as, e.g., 30 or 60 seconds, the container security device 110 is armed. Alternatively, after being de-coupled from the interface 229, the remote arming plug 300 may be in communication with other parts connected somewhere on the container security device 110 and may become a part of the mechanical seal that is used to physically seal the container door 105.

When the remote arming plug 300 is initially removed, the container security device 110 enters a pre-armed state and then when the doors 105 are closed, and after a countdown, the container security device 110 enters an armed state. The doors 105 of the container security device 110 are then closed, and starts the count-down when a sensor senses that the magnetic flux density is proportional to the gap between the doors 105 and the door frame (i.e., by measuring the Hall Effect). Alternatively, when pressure from the gasket of the door 105 reaches the appropriate limit for container security device 110 arming, the count-down starts. The bolt 305 and the remote arming plug 300 may then be coupled together around a hasp on the container's door, as described with respect to FIGS. 6A-D.

The unique identifier of the remote arming plug 300 may communicate its identity to the container security device 110, and the container security device 110 will start its countdown timer. The container security device 110 has the necessary instructions to read the unique identifier from the remote arming plug 300 and initiate the arming process.

If the doors 105 are opened during the countdown, the arming of the container security device 110 fails. If all of the arming criteria were otherwise met, the container security device 110 automatically arms itself and thereby consumes one of the pre-loaded keys. Accordingly, the container security device 110 is now in an armed condition, which is identical to what would have happened if a reader had armed the container security device 110. If the doors 105 are opened after the container security device 110 has been armed, an alarm goes off.

The remote arming plug 300 is single-use or disposable (i.e., only good for one trip—(one "arming" and one "disarming" of the container security device 110)). The remote arming plug 300 can be viewed as the physical embodiment of an arming key that may also be used as an ISO 17172-compliant mechanical seal, or as seal compliant with any derivatives/improvements of ISO 17172. The remote arming plug 300 may be physically connected to the container security device 110, e.g., (but not limited to) via the data port connector of the interface 229. The remote arming plug 300 is registered and linked to a certified shipper/user in a user server when purchased. It is possible to cross-match the shipper on a manifest so that unauthorized users of remote arming plugs 300 are avoided.

In an embodiment, the unique serial number is the remote arming plug ID. The unique serial number is issued by the authentication server and there is no way to duplicate it. As discussed above, the serial number may be physically written or marked (e.g. barcode) on the remote arming plug 300, and is programmed in an internal computer memory of the remote arming plug 300. The remote arming plug ID is read by and programmed in the container security device 110 once the container security device 110 is armed. The container security device 110 uses the remote arming plug ID to calculate the unique arming key. In some embodiments, the remote arming plug 300 is combined with the mechanical seal, in which case the remote arming plug ID is the mechanical seal ED. The remote arming plug ID can be read manually, wirelessly (e.g., via WID or Bluetooth), via ultra-sonic or infrared, or via contact.

The remote arming plug 300 may be distributed to the shipper who stuffs and seals the container 100 in different ways. In a first way, the shipper utilizes an empty container 100 onto which a container security device 110 is already installed. The remote arming plug 300 would already be plugged into the container security device 110.

In a second way, the remote arming plug 300 is distributed with the container security device 110 when the container security device 110 is being recycled. The remote arming plug 300 would already be plugged into the container security device 110.

In a third way, the remote arming plug 300 is distributed in a "box" (like mechanical seals are distributed), separate from the container security device 110. The remote arming plug 300 then has to be plugged into the container security device 110 before arming.

Figure 4:
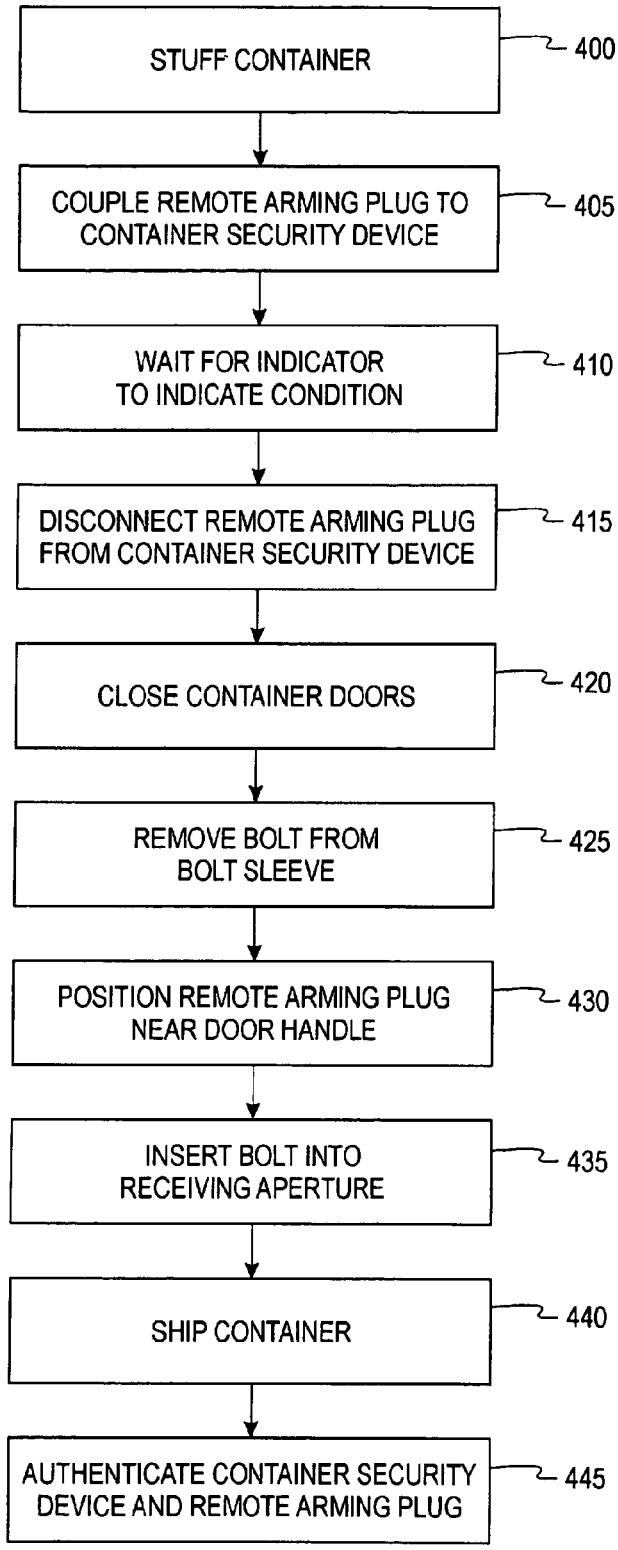
FIG. 4 illustrates the remote arming process of a container security device according to an embodiment of the invention.

FIG. 4 illustrates the remote arming process of a container security device 110 according to an embodiment of the invention. First, at step 400, the container 100 in which the container security device 110 is located is stuffed with the items being shipped. Initially, the remote arming plug 300 and the container security device 110 are physically separate devices. Next, at step 405, the remote arming plug 300 is coupled to the container security device 110. Specifically, the remote arming plug 300 is physically plugged into the container security device 110 by means of a connector (e.g., the connector could be made without using the RS-232 data port). Alternatively, the remote arming plug 300 may be in communication with the container security device 110 by a wireless or a contact connection. The container security device 110 may be distributed to a shipper.

As described above with respect to FIGS. 3A-C, the remote arming plug includes an indicator 325 that intuitively indicates when the remote arming plug 300 is first coupled to the container security device 110. After the unique identifier of the remote arming plug has been communicated to the container security device 300, this status is indicated by the indicator 325. For example, if the indicator 325 is an LED, the LED may become a solid red color. In other embodiments, LED colors other than red or green may be utilized. Also, an indicator 325 other than an LED may also be utilized. At step 410 of the process shown in FIG. 4, the shipper waits for the LED indicator 325 to indicate that the unique identifier has been successfully communicated.

At step 415 the shipper disconnects the remote arming plug 300 from the container security device 110. When the container security device 110 senses the doors 105 are closed and that a remote arming plug 300 is present, the container security device 110 triggers its arming sequence by first reading the remote arming plug ID off of the remote arming plug memory. The container security device 110 generates a unique encrypted arming key by combining the remote arming plug ID and secret tag key (this process can only occur once per remote arming plug ID, meaning a fake remote arming plug with an identical remote arming plug cannot trigger the container security device 110 to arm again). The remote arming plug ID is programmed in the container security device 110 memory as the load ID (mechanical ID). The container security device 110 is now armed. If the doors 105 are open from now on, the arming key is erased, which blocks the container security device 110 from being armed with the same remote arming plug ID as described above.

The shipper closes the container doors 105 at step 420. At step 425 the bolt 305 is removed from the bolt sleeve 310. The shipper then positions the remote arming plug 300 near the door handle of the container doors 105 at step 430. At step 435, the shipper inserts the bolt 305 into the receiving aperture 315 of the remote arming plug 300. When the remote arming plug 300 is taken out of the container 100, it may be used as a part of the mechanical seal and thus used to physically seal the container doors 105 (or it is discarded). In the event that the remote arming plug 300 becomes a part of the mechanical seal after the container security device 110 has been armed, the remote arming plug ID, which is readable from the outside, now becomes the mechanical ID, which in turn is marked on the manifest (bill of lading). The manifest information along with remote arming plug LD and container ID etc. is sent or communicated to a user server, which verifies that the shipper is authorized, i.e., matches the remote arming plug ID with that user (ID). If they are not the same, then this shipment should be targeted.

The shipper ships the container 100 at step 440. Finally, the shipper authenticates the container security device 110 and the remote arming plug 300 at step 445. In other embodiments, an e-seal, a cable seal, or any other ISO 17172-compliant seal may be utilized instead of a bolt seal.

The container security device 110 is interrogated by a reader (handheld or fixed) along the supply chain, and the container security device 110 is authenticated with the authentication server 140 (using the challenge/response method). Both the container security device 110 and the remote arming plug 300 are registered in the authentication server 140. Since the container security device 110 and the authentication server 140 are using the same algorithm to calculate the arming key from remote arming plug ID, the arming key in the container security device 110 could be matched with the arming key in authentication server 140 (this is the same challenge/response method used as for container security devices 110 that have been "regularly" armed with a reader). Another thing that needs to happen when the container 100 passes a reader, is that the ID of the container security device 110 that this remote arming plug 300 was used to arm should be reported to the user server.

Once both the container security device ID has been reported by a reader, and the manifest has been submitted, a comparison should be made with the manifest declared container ID and the reported ID to verify that they are the same. If they are not the same, then this shipment should be targeted. If a manifest has been submitted for a container security device 110 that is armed with a remote arming plug 300, and this manifest does not contain the remote arming plug ID, then this shipment should be targeted for inspection.

At the receiving end, when the mechanical seal is cut and the container doors are opened (without disarming the container security device 110 with a reader), the arming key is erased and container security device 110 will log an alarm. However, the physical part of the mechanical seal which is the remote arming plug 300 (not the bolt), may be used to verify that the it is the same remote arming plug ID that was used to arm container security device 110 at the point of stuffing and if it is, this may cancel the alarm of the container security device 110, i.e., cause the alarm to disarm. This is done by simply plugging the remote arming plug 300 back into the container security device 110. This can only be done once and only with the doors open (and remained open for at least 30 seconds). This can only be done if container security device 110 has been armed with this remote arming plug ID, and relies on this specific sequence i.e. arming and closing with the same remote arming plug 300 (meaning one will not succeed if one tries to disarm twice). This sequence will erase the remote arming plug ID in the container security device 110, which will be logged in the container security device 110, so there is no way the container security device 110 can be "dis-armed" this way and "re-armed by putting back a "false" remote arming plug 300 with an identical remote arming plug ID.

After the container security device 110 has been activated, the shipper has to transmit the serial number of the remote arming plug 300 to the authentication server 140 so that the container security device 110 can be authenticated by the next entity in the shipping chain that has a reader. The shipper maintains a shipping manifest that lists everything that has been stuffed into a particular container 100. The shipper also includes the serial number of the remote arming plug 300 on the shipping manifest. The shipper marks the arming plug ID on the shipping manifest. The shipping manifest is communicated to the authentication server 140 in some way (e.g., via e-mail, fax, etc.) before the authentication process can take place. The authentication process takes place the next time the container 100 passes a reader that is on-line with the authentication server 140.

Figure 5:
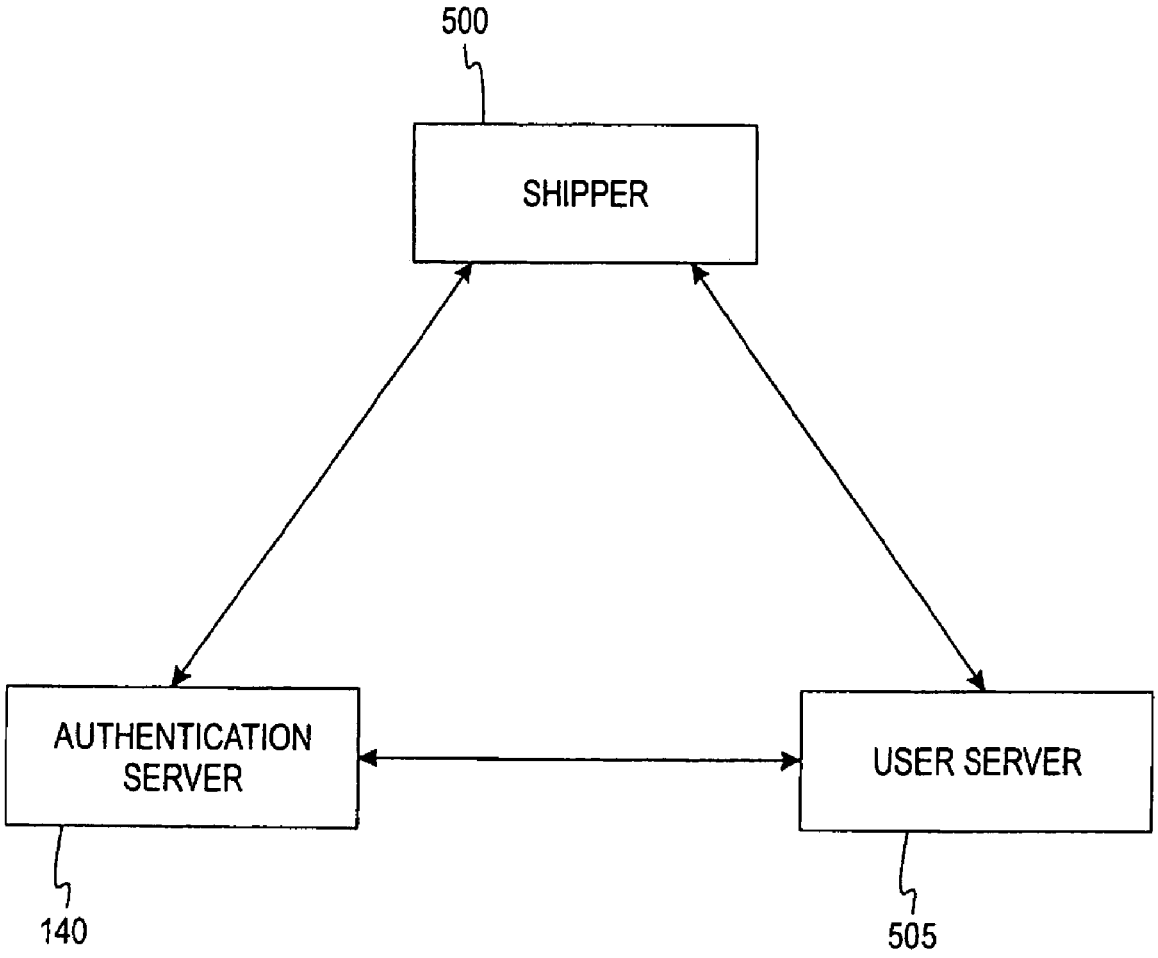
FIG. 5 illustrates the remote arming system including the shipper in communication with the authentication server and a user server.

As shown in FIG. 5, the shipper 500 is in communication with the authentication server 140 and a user server 505. The communication links may be via the Internet or a secure telephone call. Alternatively, the communication links may occur via facsimile, email, or in any other suitable manner. The user server 505 assigns remote arming plug IDS.

Specifically, when the shipper purchases a remote arming plug 300, the user server assigns the ID, and the remote arming plug 300 is sent to the shipper 500. The shipper may have its own user identification number ("user ID") that uniquely identifies it. The user server 505 transmits the remote arming plug ID and the user ID to the authentication server 140. The user ID and the remote arming plug ID are both sent so that the authentication server 140 can associate the remote arming plug ID with one particular shipper.

Once the container 100 has been stuffed and its container security device 110 armed, the serial number of the remote arming plug 300 is sent from the shipper 400 to the authentication server 140 so that the serial number of the remote arming plug 300 can be registered. The shipper also sends the user ID to the authentication server 140. The user server 505 contains a list of all registered shippers. In the event that the user ID does not match any of the previously stored user IDS in the user server, an error may occur and an alarm on the container security device 110 may go off when someone in the supply chain eventually attempts to authenticate the container security device 110 with a reader.

After the container security device 110 is armed and the serial number of the remote arming plug 300 has been registered with the authentication server 140, the container security device 110 still has to be authenticated at some point by the authentication 110 server 140. A reader may be utilized for this authentication. For example, after the container 100 is shipped, a subsequent entity in the supply chain may utilize a reader to authenticate the key in the container security device 110. Specifically, the reader reads the key from the container security device 110 and transmits the key to the container security device server 140. In order to authenticate the container security device 110, the original shipper and the serial number of the remote arming plug 300 must be stored within the authentication server 140.

The next entity in the shipping chain having a reader may authenticate the container security device 110. The next entity may be located at, e.g., a distribution center or a marine terminal. If the container security device 110 has not been pre-registered properly or the arming key is authenticated by the authentication server, an alarm will be generated. During the authentication process, the container security device 110 is matched up with the serial number of the remote arming plug 300 and the user ID.

Figure 6A:
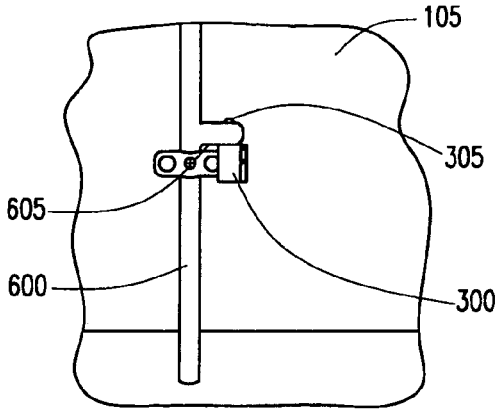
FIGS. 6A-D illustrate containers having different locations for securing the mechanical seal having the remote arming plug.

There are several locations on which a mechanical seal may be placed on the doors of the container. FIGS. 6A-D illustrate containers having different locations for securing the mechanical seal having the remote arming plug 300. Each of these locations may be a door securing device. FIG. 6A illustrates an embodiment where the mechanical seal is coupled to an "Enhanced Lock Device" by P&O Nedlloyd.

As shown, the container 100 may include a number of vertical rods 600 extending along from the top to the bottom of the container doors 105. In an area approximately halfway up one of the vertical rods 600, a hasp 605 is located that is attached to the vertical rod 600. In the event that the mechanical seal is a bolt seal, the bolt 305 may be inserted through the hasp 605 and may be coupled to the remote arming plug.

Figure 6B:
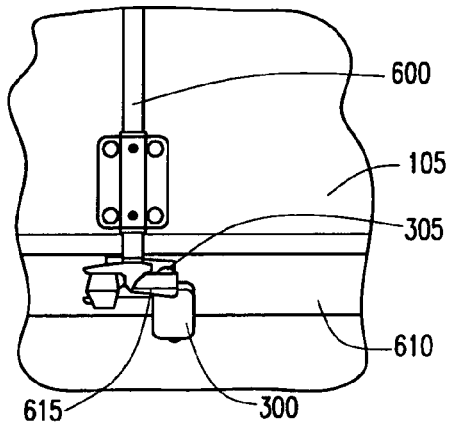

FIG. 6B illustrates an embodiment where the mechanical seal is coupled to a "SecureCam." As shown, the container 100 includes a number of vertical rods 600 extending along from the top to the bottom of the container doors 105. In an area near the bottom end of one of the vertical rods 600, a hasp 615 is located that is attached to the vertical rod. The mechanical seal is utilized to secure one of the vertical rods 600 to a bottom portion 610 of the container 100 so that the container doors 105 cannot be opened without breaking the mechanical seal. In the event that the mechanical seal is a bolt seal, the bolt 305 may be inserted through the hasp 615 and may be coupled to the remote arming plug 300.

Figure 6C:
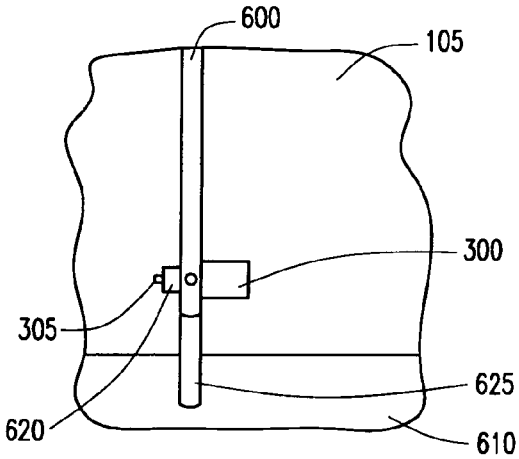

FIG. 6C illustrates an embodiment where the mechanical seal is coupled to a "Pardo Hole." As shown, one of the vertical rods 600 is coupled to a lower rod 625 by the mechanical seal. The lower rod 625 may be coupled to the bottom portion 610 of the container 100. When sealed, the container doors 105 cannot be opened without breaking the mechanical seal.

Figure 6D:
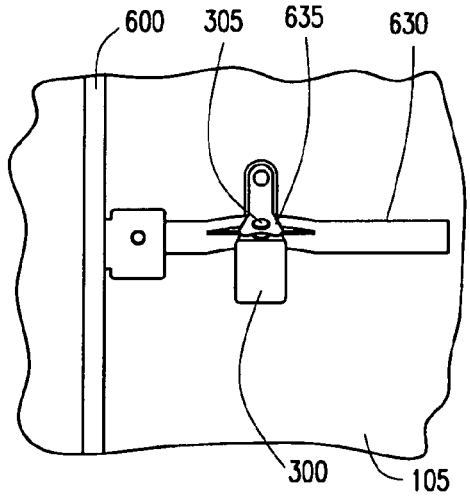

FIG. 6D illustrates an embodiment where the mechanical seal is coupled to a door handle 630 of the container 100. As shown, one of the vertical rods 600 is coupled to the door handle 630. A hasp 635 is positioned above the middle portion of the handle 630. In the event that the mechanical seal is a bolt seal, the bolt 305 may be inserted through the hasp 635 and may be coupled to the remote arming plug 300, so that the handle 630 is secured. When sealed, the handle 630 cannot be moved to open the container's doors 105 without breaking the mechanical seal.

FIGS. 6A-D illustrate only four of many possible different locations for attaching a mechanical seal to the container 100. In other embodiments, the mechanical seal can be located anywhere suitable on the container 100 to secure the container doors 105. In other embodiments, a cable seal, e-seal, or other ISO 17172-compliant seal may be utilized.

Figure 7:
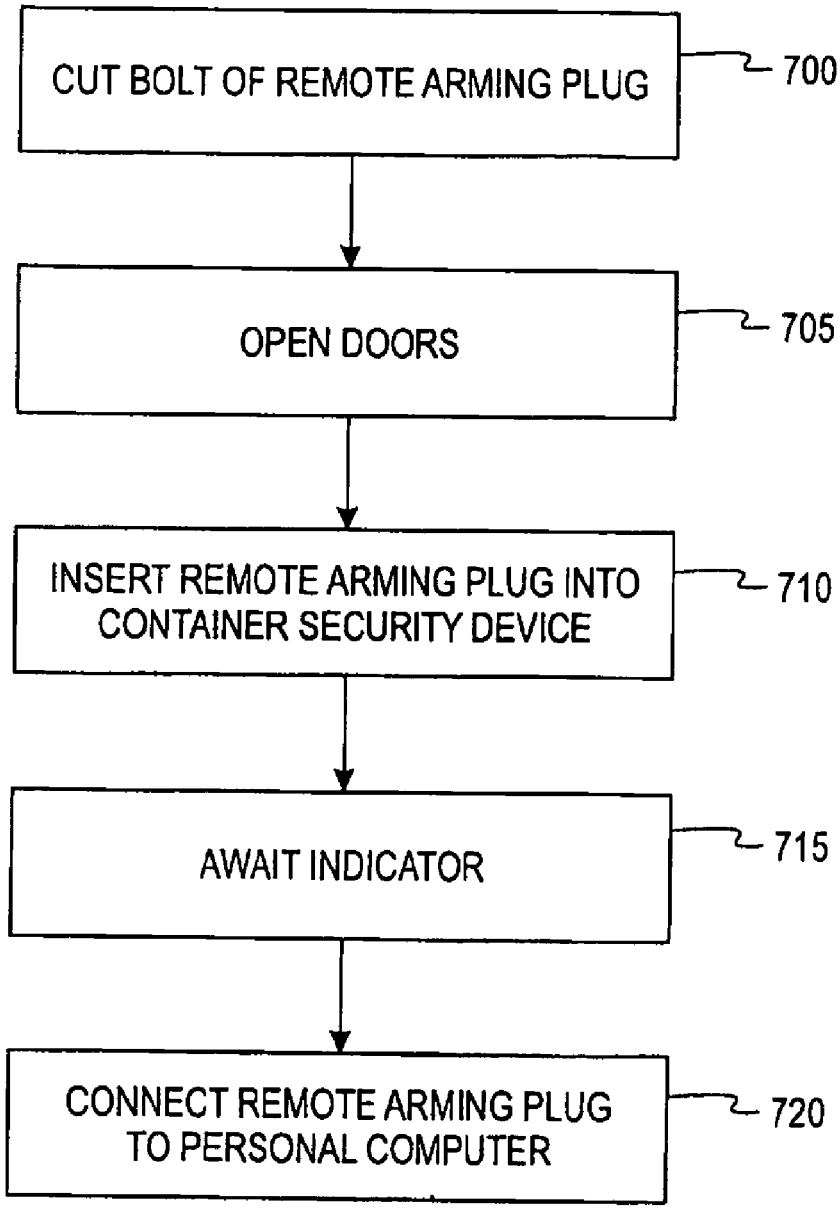
FIG. 7 illustrates a method of utilizing the remote arming plug as part of a mechanical seal and for monitoring a shipment of a container.

FIG. 7 illustrates a method of utilizing the remote arming plug 300 as part of a mechanical seal and for monitoring a shipment of a container 100. First, after the container 100 has been received at its final destination, the bolt 305 of the remote scanning plug 300 is cut at step 700. Next, at step 705, the doors 105 of the container 100 are opened. The remote arming plug 300 is inserted into the container security device 110 at step 710. The user then awaits an indication from the indicator 325 at step 715. The remote arming plug 300 is connected to the container security device 110 to verify that the remote scanning plug's 300 unique identifier (to ensure that the remote arming plug 300 is the same one that initially armed the container security device 110). An alarm of the container security device 110 is cancelled in the event that the unique identifier is the same. A log of the container's 100 shipment may then be downloaded to the remote arming plug 300.

Finally, at step 720, the remote arming plug 300 may be connected to a personal computer so that the log can be sent to a server for analysis. The remote arming plug 300 may be coupled to the container security device 110 to download the log via an RS-232 connector. Alternatively, the container security device 110 may communicate the log to the remote arming plug 300 via infra-red, contact, I-button, ultra-sonic, a magnetic method, or in any other suitable manner for transmitting data. In other embodiments, instead of the remote arming plug 300 directly connecting to the container security device 110, the remote arming plug 300 may instead be coupled to a sensor bus that is in communication with the container security device 110, such that the remote arming plug is indirectly connected to the container security device 110.

Figure 8A:
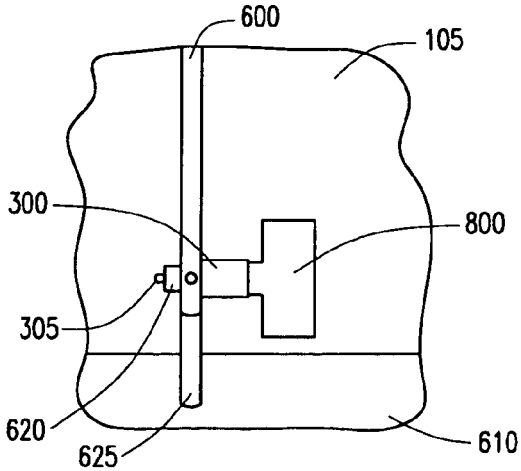
FIGS. 8A-B illustrate a token for coupling to the remote arming plug.
Figure 8B:
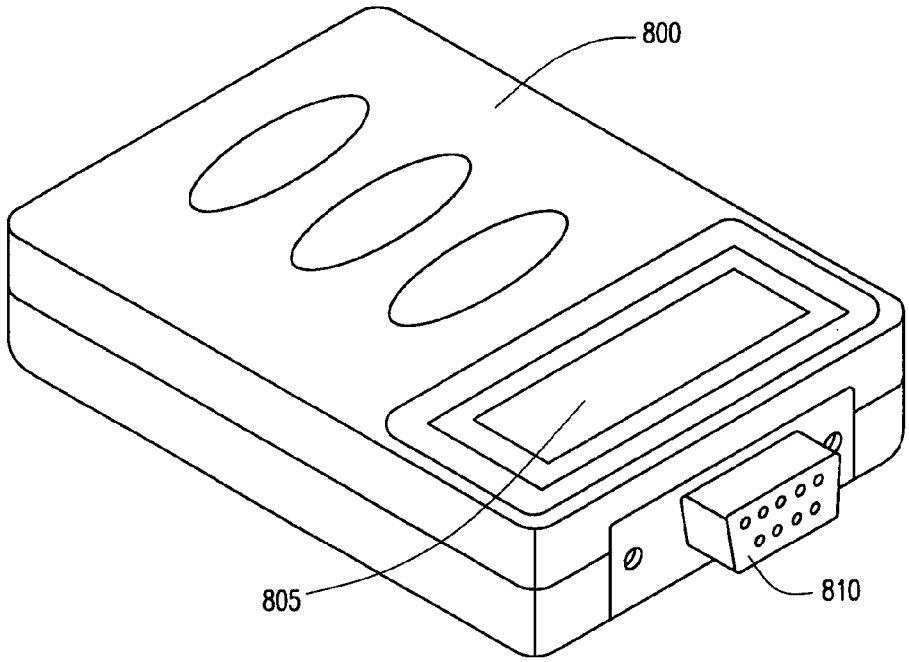

FIGS. 8A-B illustrate a token device 800 for coupling to the remote arming plug. (The doors 105 of the container 100 are omitted from FIGS. 8A and 8B for illustrative purposes.) When the remote arming plug 300 is secured to the container door via the bolt 305, the male end 320 of the remote arming plug is not being used. Accordingly, an entity along the supply chain can couple the male end 320 of the remote arming plug 300 to the token 800 to read the unique identifier from the remote arming plug 300. Alternatively, the remote arming plug 300 may contain an infra-red or wireless transmitting element, such as an RFID chip or a Bluetooth element for wirelessly communicating the unique identifier of the remote arming plug 300 to the token 800 or some other device. Accordingly, both the unique identifier of the remote arming plug and the arming key of the container security device can both be utilized for authentication purposes.

As shown in FIG. 8B, the token 800 may include a display 805 and a connector 810. The connector 810 is adapted to plug into the male connector of the remote arming plug 300.

The token 800 may verify that the remote arming plug contains the correct unique identifier (i.e., the token 800 may authenticate the remote arming plug 300). The token 800 may also authenticate the user of the remote arming plug 300 who initially armed the container security device 110 with the remote arming plug 300. The authentication of the user may be formed according to the method described above with respect to FIG. 4. In some embodiments, in addition to the arming plug 300, a token is required to complete the arming process. The token is utilized so that the identity of the person/entity sealing the container 100 is known with some certainty. A reason for use of the token is in case a remote arming plug 300 is stolen, so that if the theft is discovered in time, it would be detected by a reader or the token 800 described above with respect to FIGS. 8A-B. The token makes it impossible for someone not authorized to seal a container 100 to arm the container security device 110 unless they also have the token.

Only authorized persons would have access to such a token. In some embodiments, the token requires biometric authentication prior to use. In other embodiments, the person/entity is required to enter a password. The token is utilized to ensure that only the person/entity who purchased the remote arming plug 300 can utilize the remote arming plug 300. The token may authorized only for a limited period of time. After expiration of the period of time, the token can no longer participate in the arming process.

Alternatively, instead of using a token, the person/entity may target a specific container 100. This could be done, e.g., before the container 100 ships, by plugging the remote arming plug 300 into a personal computer, logging onto a website, and entering the container 100 for which the remote arming plug 300 and shipment are targeted. The remote arming plug 300 could be programmed with a special code that is only usable by that particular container 100. Accordingly, if the remote arming plug 300 is stolen, it would be useless to arm any container 100 except the one that the user/entity wants to arm for the shipment.

There are several ways in which the shipper/user can be authenticated. One way to authenticate a shipper is after the container security device 110 has been armed. First, the container security device 110 is coupled to the remote arming plug 300 to arm the container security device 110. During the arming, a unique identifier for the remote arming plug 300 is communicated to the container security device 110. Similarly, a container security device ID of the container security device 110 may be communicated to the remote arming plug 300. The shipper then removes or breaks off a portion of the remote arming plug 300. The remainder of the remote arming plug 300 may then be used as a part of the mechanical seal. The portion removed from the remote arming plug has a same unique identifier/serial number as was communicated to the container security device 110. The shipper brings the removed portion of the plug to a personal computer, or some other device having the ability to communicate with a back-end system. For example, the removed portion of the remote arming plug 300 may have a USB jack, a serial port jack, or have an ability to wirelessly or communicate in any other manner the unique identifier to the personal computer. The shipper may then login to effectively declare that the remote arming plug 300 was used to arm a particular container security device 110. An ID of the container 100 may also be associated with the remote arming plug 300 and the container security device 110.

Another way to authenticate the shipper is before the container security device 110 has been armed. First, the shipper couples the remote arming plug 300 to the personal computer and logs in to indicate that he/she desires to arm a particular container 100. A unique identifier is then downloaded onto the remote arming plug 300 that is specifically intended for the one container 100. This ensures that someone cannot steal the remote arming plug 300 and use it to arm a different container 100.

An additional way to authenticate the shipper is while the container security device 110 is being armed. A token, such as an electronic device having a keypad, is placed in communication with the container security device 110 and the remote arming plug 300. They may communicate wirelessly, or via contact, in some embodiments.

Alternatively, the remote arming plug 300 may be plugged into the token that is itself plugged into the container security device 110. The token is utilized to authenticate the shipper. For example, the shipper may be required to enter a PIN code into the token. Once the PIN code has been acquired, the token is enabled to communicate and give its unique ID to the container security device 110. Later, when the container security device 110 is read by a reader, the unique ID of the token is reported.

The token may be assigned to the shipper, where a PIN code is stored in the token, and it is the one that checks the PIN code. Over time, the PIN code needs to be retired, and the token refreshed. For example, an RSA rolling code type token. Accordingly, the identifier of the token periodically changes. The shipper may log into a Virtual Private Network ("VPN"). The shipper enters the shipper ID, the PM code, and the token's current displayed value. The PM code is for the remote arming plug 300, not the shipper. On the back end, the system knows that this token was assigned to the particular shipper and it can prove that the current holder of that token is the correct person because the proper number was displayed on the token at the time.

The token may provide power for the scanning operation so that it is not possible to arm the container security device 110 without it. The token may also be used to disarm the container 100. Use of the token to disarm the container provides some certainty as to who disarmed the container 100.

The token may read the unique identifier from the mechanical seal, e.g., via RFID, barcode, etc. This would allow all active electronics to be removed from the seal. The token may also work with electronics in the seal.

The token may download the container security device log as part of the disarming process. There are cost and reliability advantages to using the token rather than the remote arming plug 300 for downloading. For example, someone disarming 10-20 containers at a retail store may then carry the plugs to a personal computer to download. If is advantageous to spend the money to add this capacity to the token than the plug. The user interface may also be the container security device ID.

The token may require some user input to be useful. The token could be "secure" in the sense that it identifies the shipper by the mere fact that the shipper has possession of the token. Accordingly, the token may require a PIN code to activate, a thumb print, other biomorphic information, or some other means of identifying the shipper.

The token may have a limited useful life of some kind with either an ability for periodic updates or created like one of the smart tokens that us used for VPN logic access with rolling codes. In that case, one would need the date/time of the transaction, the value of the token at that time, and a PIN code from the shipper. This would provide a 2-factor level of security without needing to expire the token.

Figure 9:
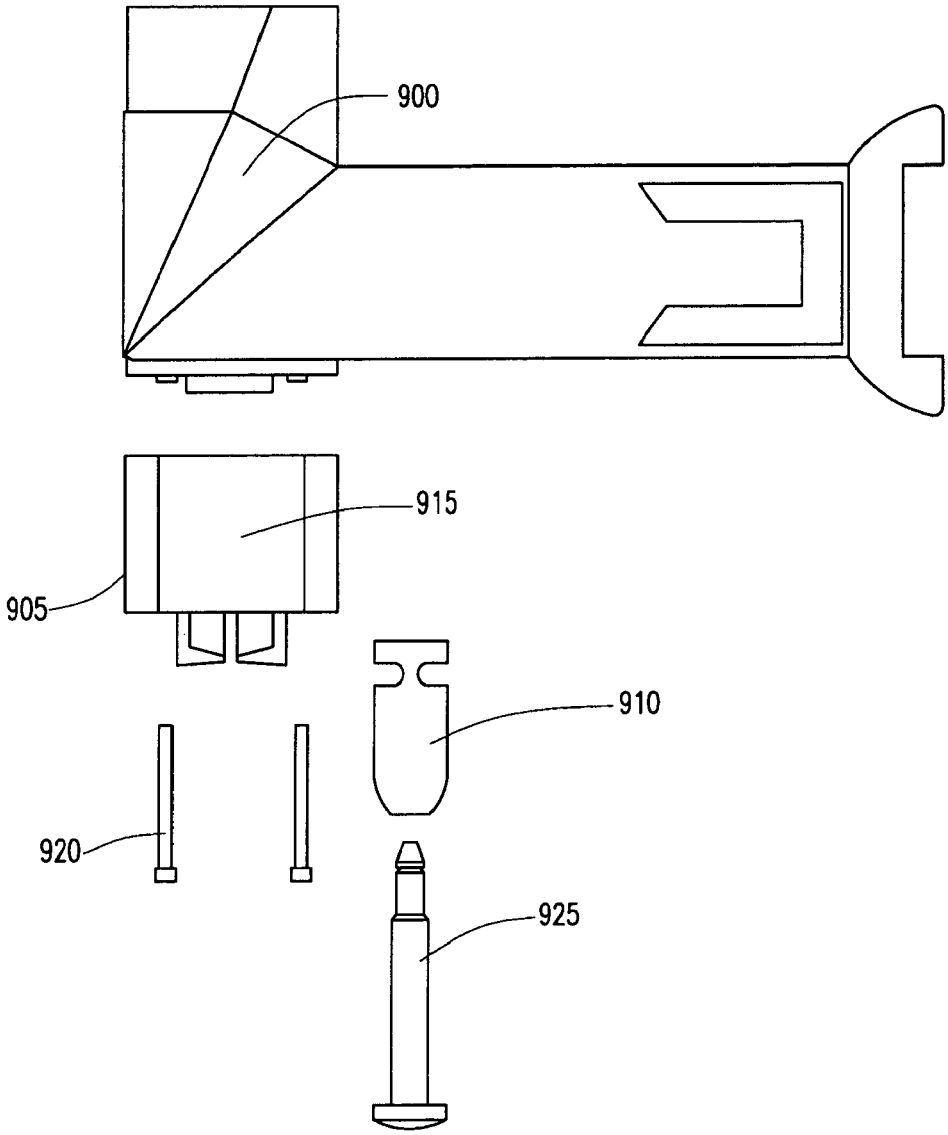
FIG. 9 illustrates a container security device, a token and a remote arming plug according to another embodiment of the invention.

FIG. 9 illustrates a container security device 900, a token 905 and a remote arming plug 910 according to another embodiment of the invention. The token 905 has a unique (user) ID and is issued by, e.g., an authentication server. The token 905 is used to remotely authenticate the container security device 900 and validate an arming done by a remote arming plug 910. It can also be used as a general ID required to identify an individual when performing other transactions and container security related procedures such as those in the US government program, Customs-Trade Partnership Against Terrorism ("C-TPAT"). As shown, the remote arming plug 910 is in communication with a bolt 925.

At the point of stuffing of a container, the token 905 is first connected to the container security device 900. The token 905 then authenticates the container security device 900 and downloads the container security device 900 number and other data (e.g., the container number) stored in the container security device 900. Next, the token 905 uploads its unique user ID to the container security device 900. The remote arming plug 910 is then connected to the token 905. The remote arming plug 910 uploads its unique identifier to the container security device 900 via the token 905. The token 905 is in communication with the container security device 900 via communication interface 930. When an indicator 915 on the token 905 shows the color, "green," the remote arming plug 910 can be disconnected from the container security device 900. This triggers the scanning sequence and the generation of the arming key in the container security device 900. The token 905 is also removed from the container security device 900. As shown, screws 920 hold the token 905 to the container security device 900.

The user subsequently takes the remote arming plug 910 and the token 905 and closes the container doors 105. The container security device 900 is now armed. The user then applies the remote arming plug 910 to a sealing location to physically seal the container 100. As another optional step, the user takes the token 905 back to his office and connects the token 905 to a computer (via an RS232 connector or any other connection) and uploads the information about the arming transaction just performed. If the user an Internet connection, the user can upload this information to a server. At the receiving end, the container security device 900 is disarmed. The bolt 925 is cut and the doors are opened, and the base of the remote arming plug 910 is intact. The user then takes his individual token 905 and connects it to the container security device 900.

The token 905 authenticates the container security device 900, and vice-versa. The remote arming plug 910 is then connected to the token 905. The container security device 900 verifies that it is the same remote arming plug 910 that was used at arming. The "green light" is subsequently displayed on the indicator 915 of the token 905. Next, the token 905 downloads the container security device 900 data and data log. As another optional step, the token 905 may be removed and taken back to the user's office to upload the transaction information to the server.

In some embodiments, the token 905 discussed above may include a display with a rolling-code number that the user could use for logging into a shipment tracking server. Also, in some embodiments, the container security device 900 authenticates the token 905. Moreover, the token 905 may use RF to communicate with the container security device 900 so that the container doors 105 could be closed when the arming is completed. Also, when the token 905 has data to be communicated with the server, this communication could be done directly by the token itself if it has a General Packet Radio Service ("GPRS") radio in it or some other form of connectivity (e.g., BlueTooth, etc.).

Figure 10:
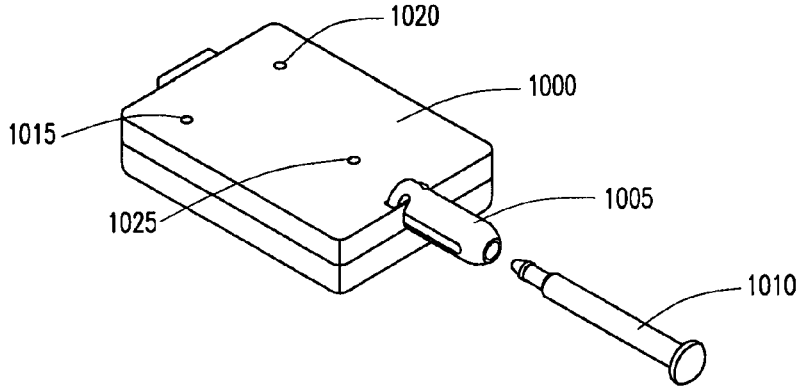
FIG. 10 illustrates a token and a remote arming plug according to another embodiment of the invention.

FIG. 10 illustrates a token 1000 and a remote arming plug 1005 according to another embodiment of the invention. As shown, the remote arming plug 1005 may be coupled to a bolt 1010. The token includes several indicator elements that may be, e.g., LEDs, including a green indicator element 1015, a red indicator element 1020, and a valid indicator element 1025. The token 1000 may be coupled to a container security device for securing a shipped container 100.

Although embodiment(s) of the present invention have been illustrated in the accompanying Drawings and described in the foregoing Detailed Description, it will be understood that the present invention is not limited to the embodiment(s) disclosed, but is capable of numerous rearrangements, modifications, and substitutions without departing from the invention defined by the following claims.

What is claimed is:

1. A container security system, the system comprising:

a sensor configured to be mounted on the container;

an arming device configured to couple with the sensor and to arm the sensor to detect an opening of a door of the container; and a unique identifier stored in a computer-readable memory of the arming device, wherein the unique identifier is configured to initiate arming of the sensor, wherein the sensor is configured to generate a unique encrypted arming key by combining the unique identifier with a tag key stored in a computer-readable memory of the sensor.

2. The container security system of claim 1, wherein the unique identifier is a serial number of the arming device.

3. The container security system of claim 1, wherein the arming device is configured to transmit the unique identifier to the sensor via a wireless connection.

4. The container security system of claim 1, wherein the sensor comprises a connector configured attach the arming device to the sensor, wherein the arming device is configured to transmit the unique identifier to the sensor over the connector.

5. The container security system of claim 4, wherein the sensor is configured to enter a pre-armed state when the arming device is detached from the connector.

6. The container security system of claim 5, wherein the sensor is further configured to enter an armed state after a countdown that begins upon detecting that the door of the container is closed.

7. The container security system of claim 6, further comprising:

a magnetic flux sensor to detect that the door of the container is closed, wherein the magnetic flux sensor is configured initiate the countdown when a magnetic flux density is proportional to a gap between the door and a door frame of the container.

8. The container security system of claim 6, further comprising:

a pressure sensor to detect that the door of the container is closed, wherein the pressure sensor is configured to initiate the countdown when pressure applied to a door gasket by the closed door reaches a predetermined limit.

9. The container security system of claim 4, wherein the arming device is further configured to seal the door of the container when the door of the container is closed.

10. The container security system of claim 9, wherein the arming device comprises:

a housing;

a bolt; and a receiving aperture formed in the housing and configured to receive an end of the bolt when the arming device seals the door of the container.

11. The container security system of claim 10, further comprising:

a bolt sleeve formed within the housing and configured to house the bolt when the arming device does not seal the door of the container.

12. The container security system of claim 1, wherein the arming device comprises a first connector, and wherein the container security system further comprises;

a token comprising a housing, a display formed in the housing, a user interface formed in the housing, and a second connector formed in the housing and configured to couple with the first connector.

13. The container security system of claim 12, wherein the token is required in combination with the arming device to arm the sensor.

14. The container security system of claim 12, wherein the token is configured to provide electrical power necessary to arm the sensor.

15. The container security system of claim 12, wherein the token is configured to activate only after receiving data input by a user.

16. The container security system of claim 15, wherein the data input by a user is a PIN code.

17. The container security system of claim 15, wherein the data input by a user is biometric.

18. An arming device, comprising:

a computer-readable memory; and a unique identifier stored in the computer-readable memory, the unique identifier configured to arm a sensor mounted to a container to detect an opening of a door of the container, wherein the unique identifier is further configured to be combined with a tail key stored in the sensor to create an arming key.

19. The arming device of claim 18, further comprising:

a housing;

a bolt; and a receiving aperture formed in the housing and configured to receive an end of the bolt when the arming device seals the door of the container.

20. The arming device of claim 19, further comprising:

a bolt sleeve formed within the housing and configured to house the bolt when the arming device does not seal the door of the container.

21. The arming device of claim 18, further comprising:

a wireless transceiver.

22. The arming device of claim 18, further comprising:

a connector configured to removably attach to a corresponding connector of the sensor.

23. The arming device of claim 18, wherein the unique identifier is a serial number of the arming device.

24. A method for securing a container, the method comprising:

receiving, using a sensor mounted on the container, a unique identifier that is transmitted from an arming device coupled with the sensor;

calculating an arming key by combining the transmitted unique identifier with a tag key stored in the sensor;

detecting that a door of the container is closed; and activating the arming key to configure the sensor to detect an opening of the door of the container.

* * * * *

UNITED STATES PATENT AND TRADEMARK OFFICE

CERTIFICATE OF CORRECTION

PATENT NO. : 7,579,948 B2
APPLICATION NO. : 11/844666
DATED : August 25, 2009
INVENTOR(S) : Bohman et al.

It is certified that error appears in the above-identified patent and that said Letters Patent is hereby corrected as shown below:

In Column 19, Line 43, in Claim 12, delete "comprises;" and insert -- comprises: --, therefor.

In Column 20, Line 18, in Claim 18, delete "tail" and insert -- tag --, therefor.

Signed and Sealed this

Eighth Day of December, 2009

David J. Kappos

David J. Kappos
*Director of the United States Patent and Trademark Office*